US008556640B2

(12) United States Patent
Mashiyama et al.

(10) Patent No.: US 8,556,640 B2
(45) Date of Patent: Oct. 15, 2013

(54) ELECTRICAL CONNECTOR

(75) Inventors: Jinichi Mashiyama, Koto-ku (JP); Toshihiko Hirai, Koto-ku (JP); Yoshinori Iwashita, Koto-ku (JP); Hiromichi Kato, Koto-ku (JP); Hidenori Ikushima, Koto-ku (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 13/542,370

(22) Filed: Jul. 5, 2012

(65) Prior Publication Data

US 2013/0012074 A1 Jan. 10, 2013

(30) Foreign Application Priority Data

Jul. 6, 2011 (JP) ..... 2011-149834

(51) Int. Cl.
*H01R 12/00* (2006.01)

(52) U.S. Cl.
USPC ..... 439/74

(58) Field of Classification Search
USPC ..... 439/74, 660
See application file for complete search history.

(56) References Cited

U.S. PATENT DOCUMENTS 8,235,733 B2 * 8/2012 Yamashiro et al. ..... 439/83
8,408,931 B2 * 4/2013 Sato et al. ..... 439/357
2010/0068900 A1 * 3/2010 Wu et al. ..... 439/74
2010/0221928 A1 * 9/2010 Sato et al. ..... 439/74
2010/0291776 A1 * 11/2010 Huang et al. ..... 439/74

FOREIGN PATENT DOCUMENTS

| | | |
|---|---|---|
| JP | 2009517802 | 4/2009 |
| JP | 2009266629 | 11/2009 |
| JP | 2010198996 | 9/2010 |
| JP | 2011107743 | 6/2011 |

* cited by examiner

*Primary Examiner* — Phuong Dinh

(74) *Attorney, Agent, or Firm* — Procopio, Cory, Hargreaves & Savitch LLP

(57) ABSTRACT

An electrical connector is miniaturized and reduced in profile height, yet maintains strength and connection stability, uses elastic fixtures as a power source and provides stable fitting. When connectors are fitted with each other, a first contact of an elastic first fixture is brought to contact a second contact of a second fixture to be used as a power source. An inclined portion of a receptacle contact and an inclined portion of an insertion hole of a housing are formed roughly in the same shape to adjust support of the receptacle contact and provide stable connection. A first chamfered portion of the receptacle contact engages a recess of a plug contact to produce a clicking feeling. The first chamfered portions are positioned and brought to contact the recesses so the plug contact is held between a contact portion and an elastic portion of the receptacle contact.

7 Claims, 11 Drawing Sheets

FIG. 1
(A)
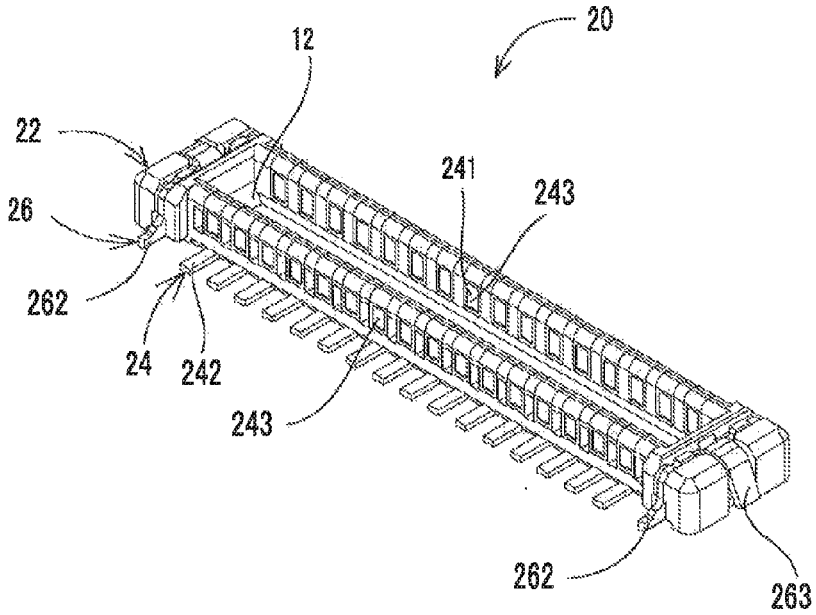
(B)
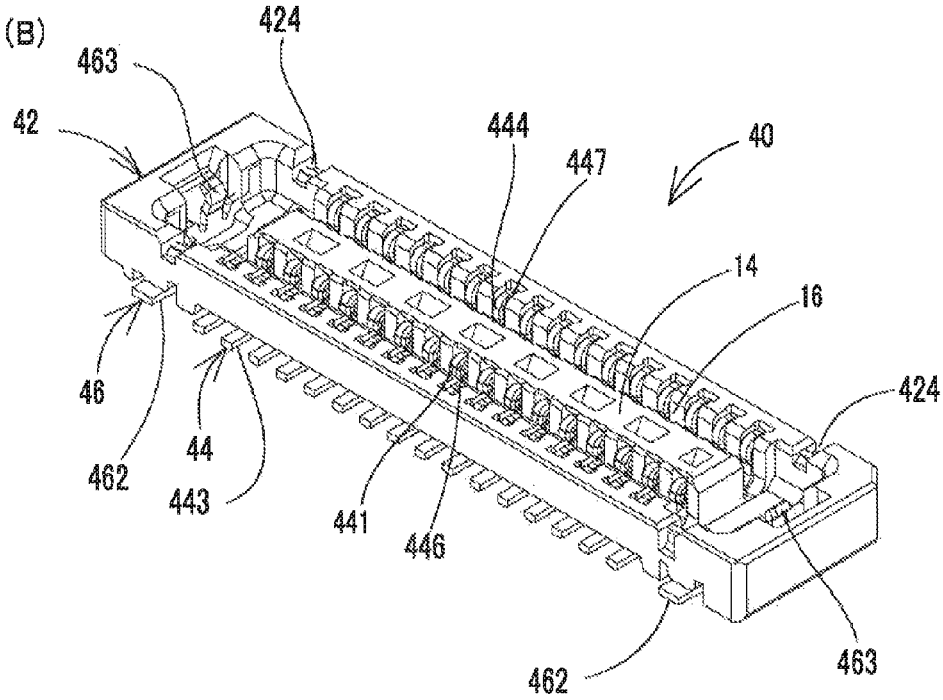

FIG. 3
(A)
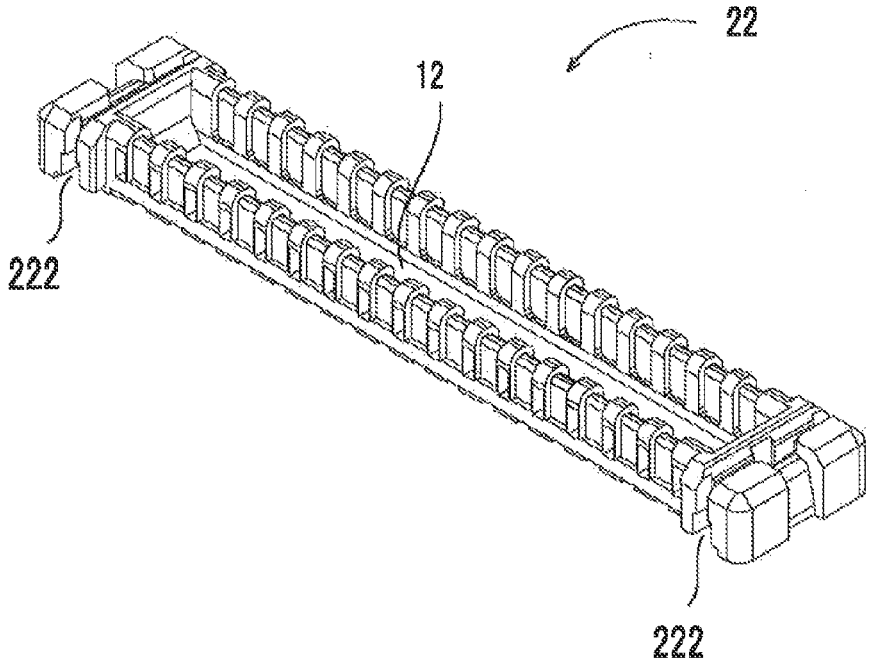
(B)
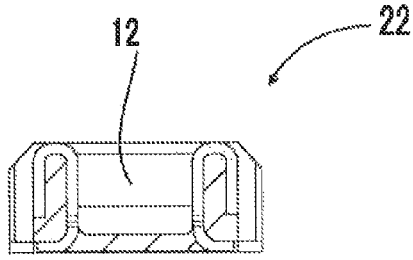

FIG. 4
(A)
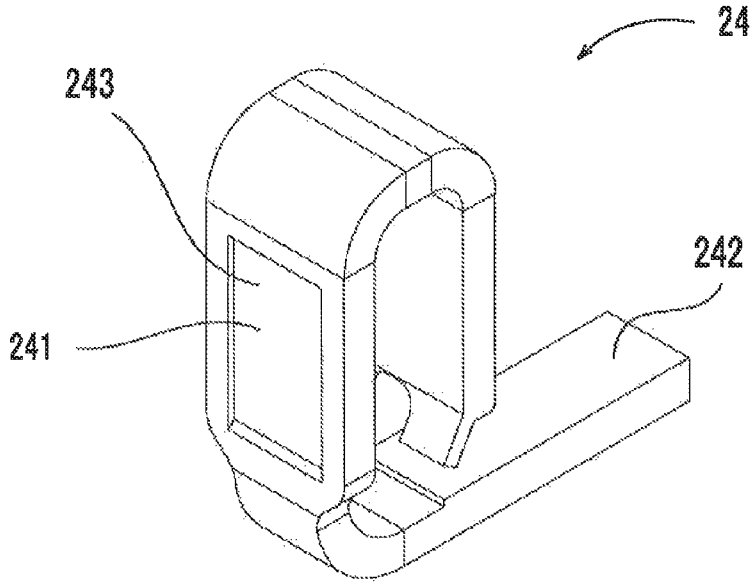
(B)
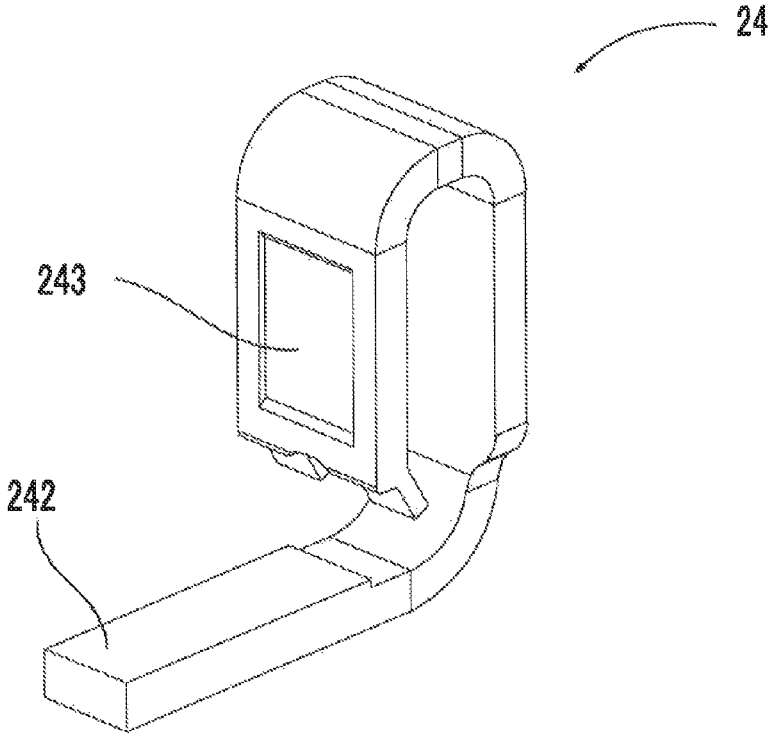

FIG. 5]
(A)
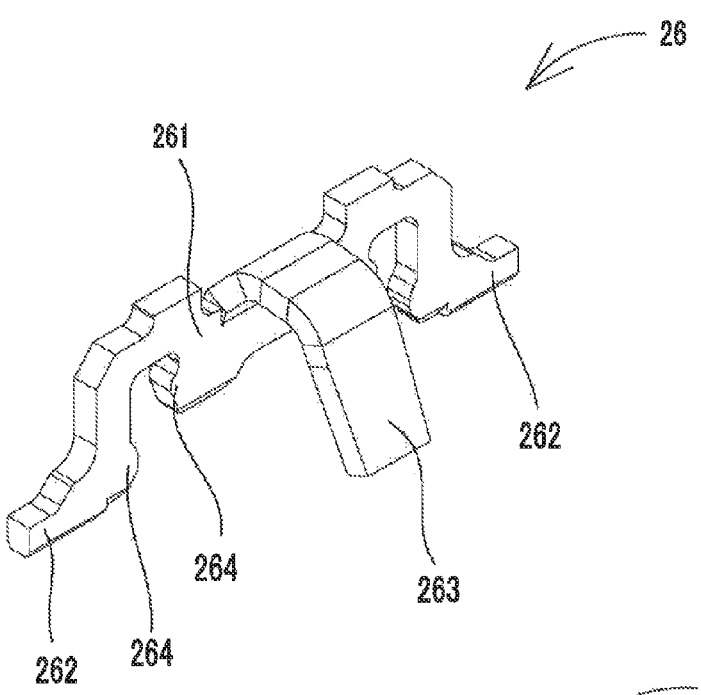
(B)
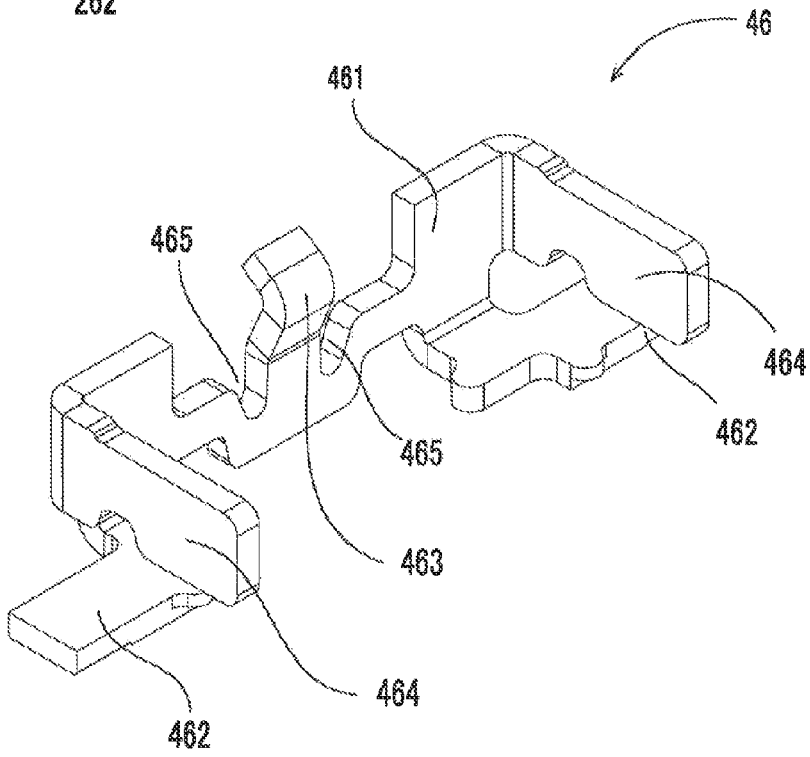

FIG. 6
(A)
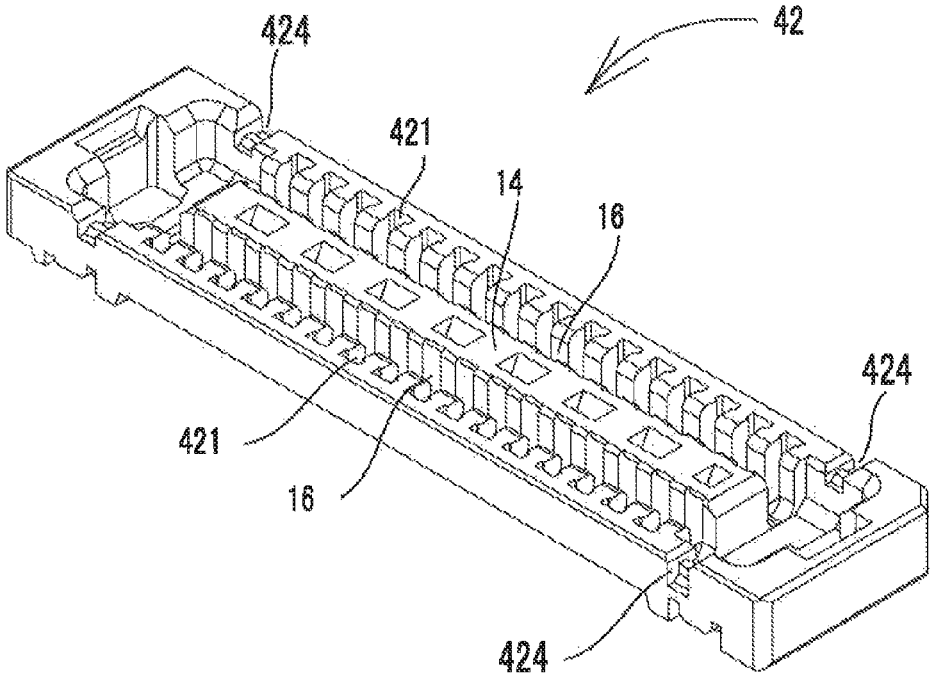
(B)
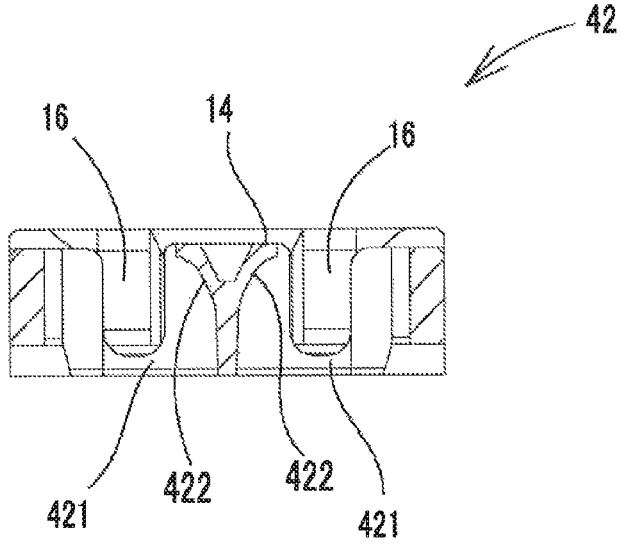

FIG. 7
(A)
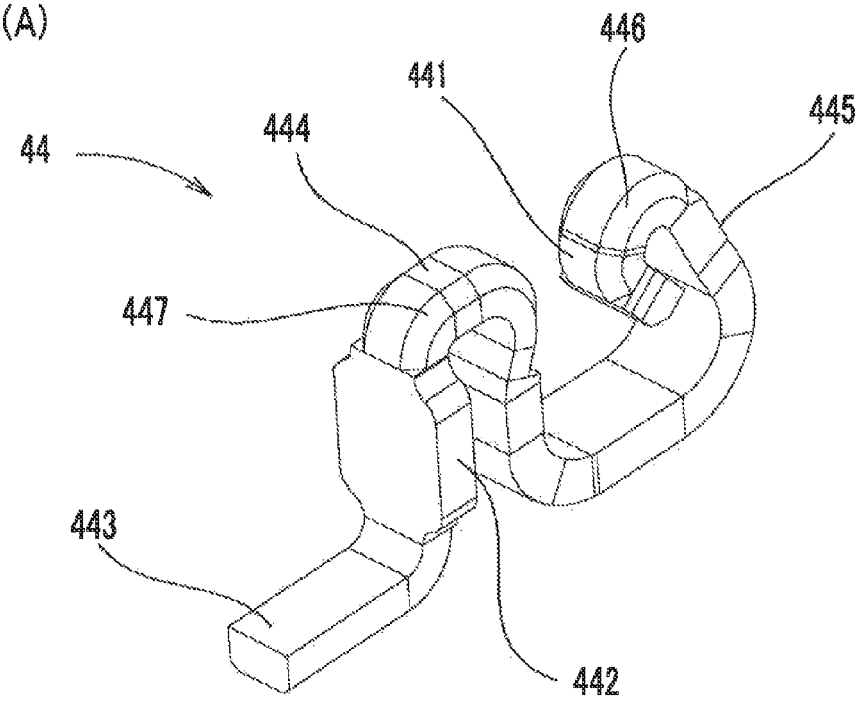
(B)
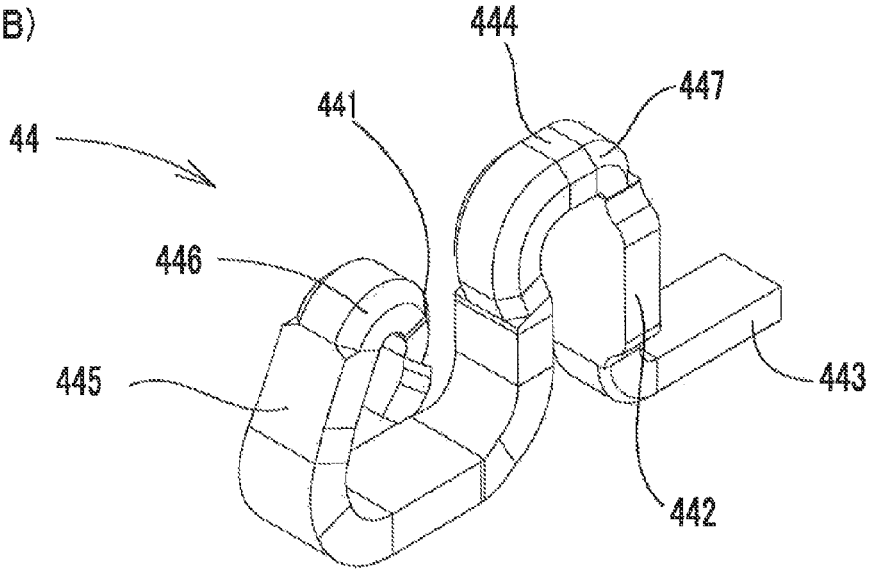

FIG. 8
(A)
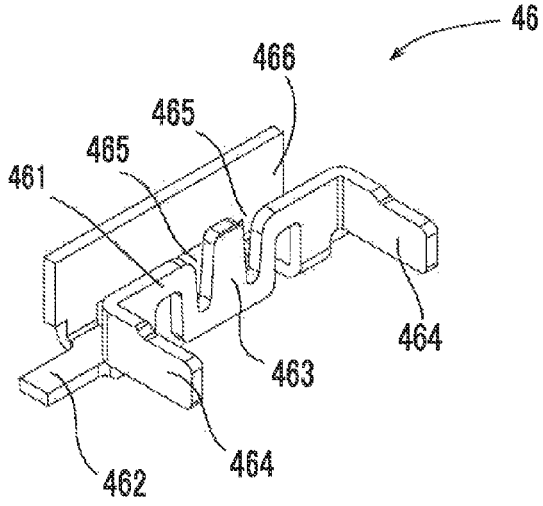
(B)
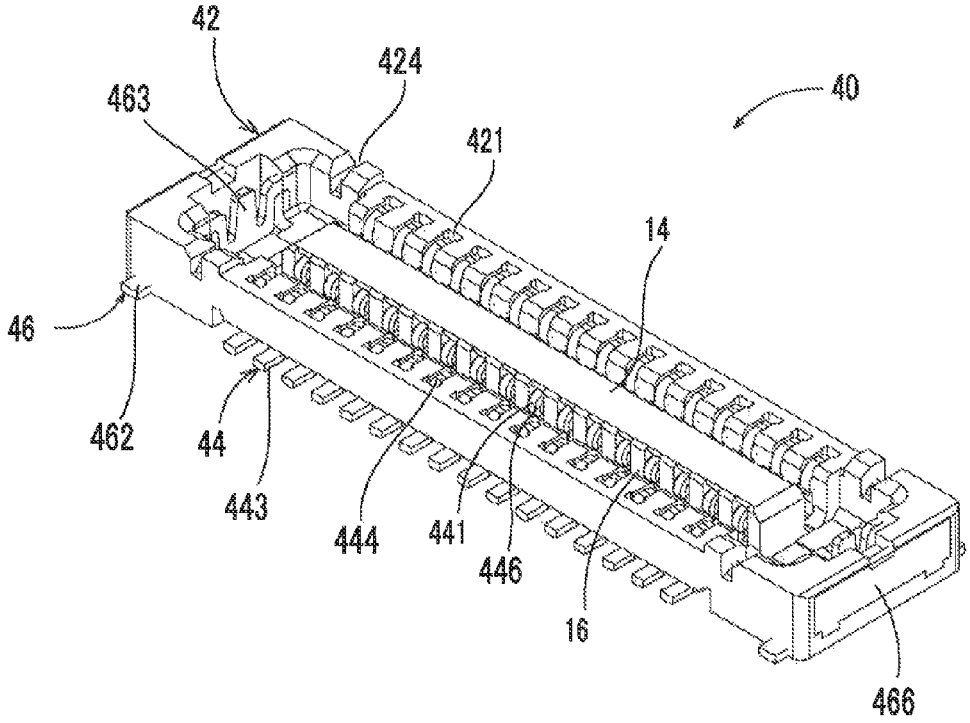

FIG. 9
(A)
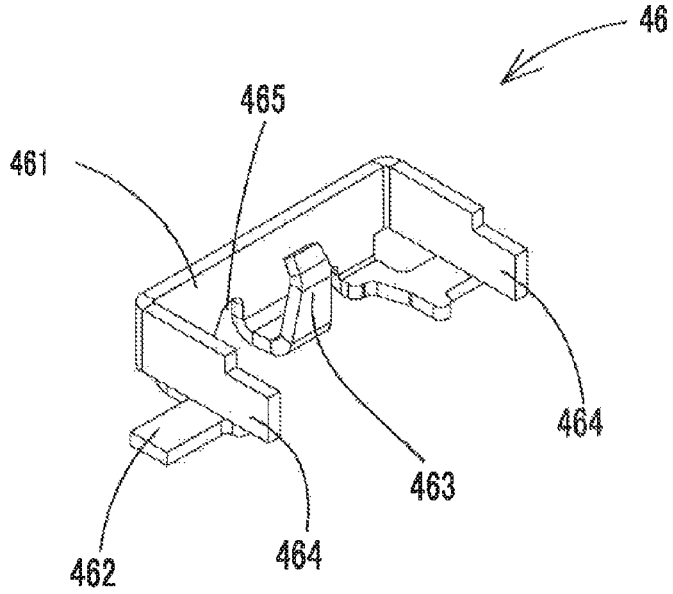
(B)
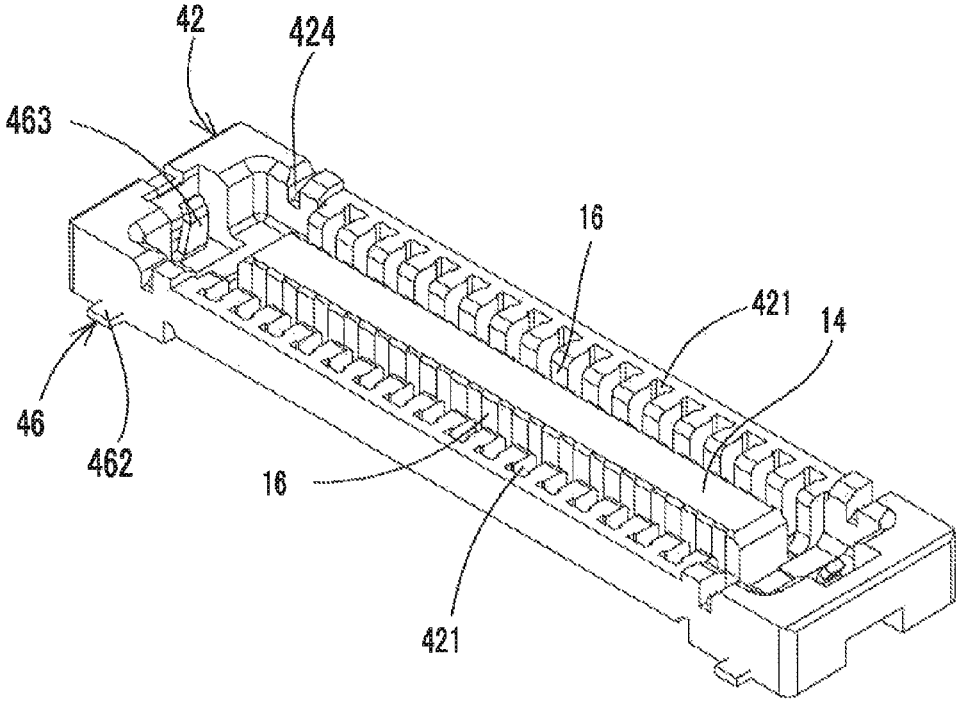

FIG. 10
(A)
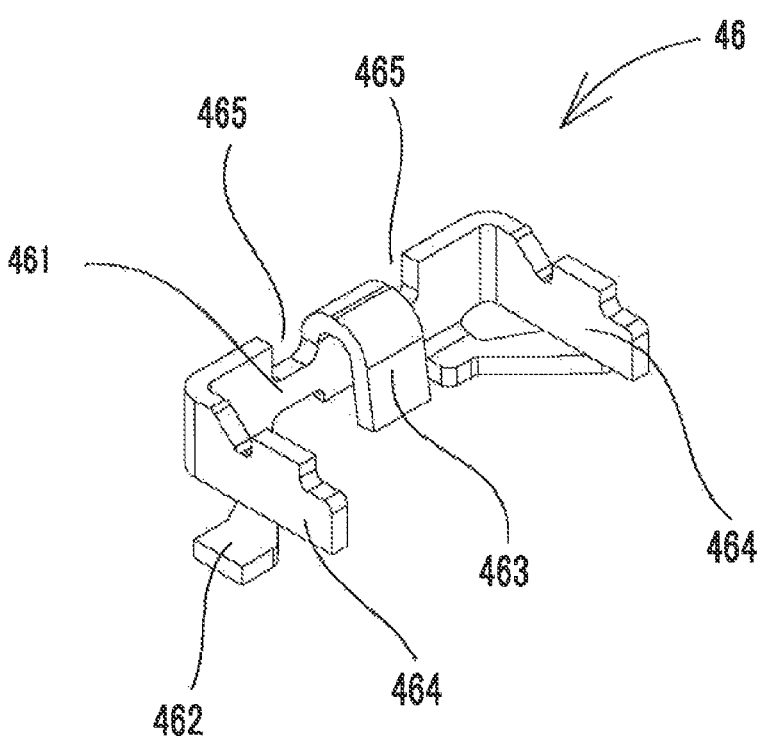
(B)
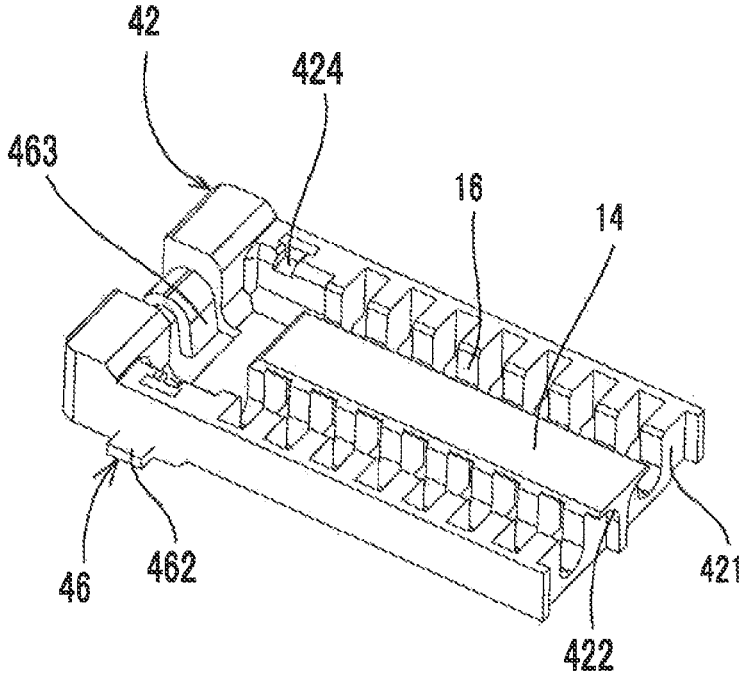

FIG. 11
(A)
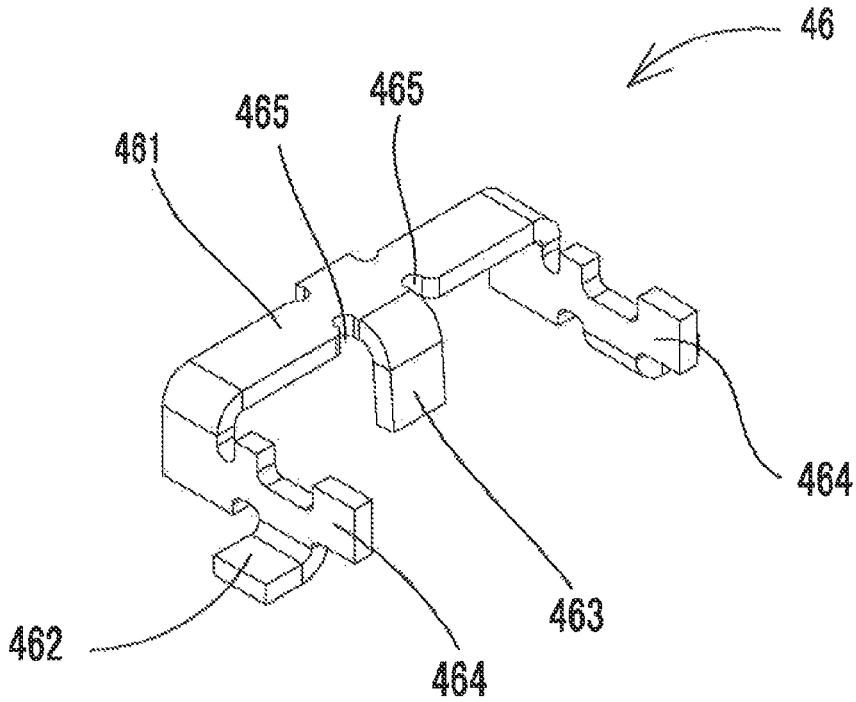
(B)
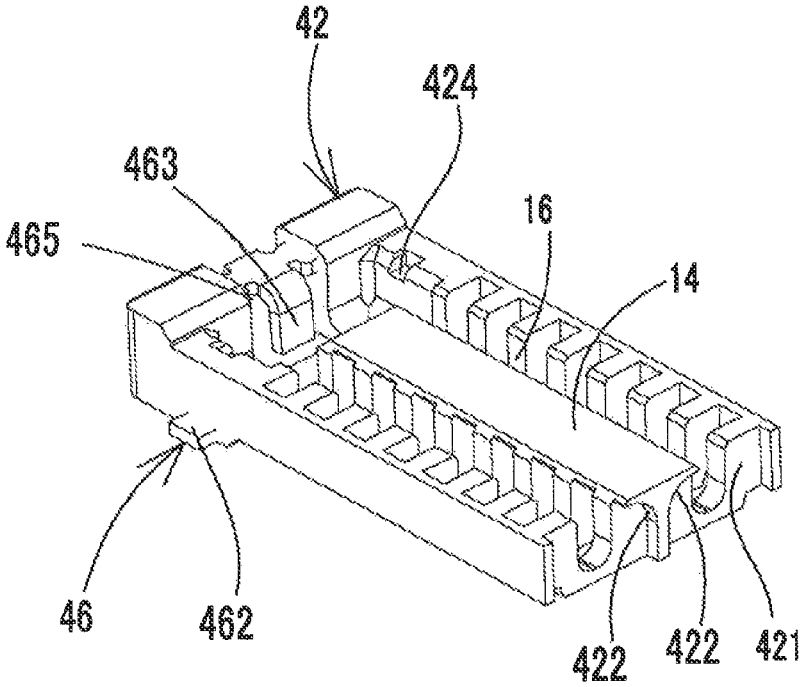

ELECTRICAL CONNECTOR

TECHNICAL FIELD OF THE INVENTION

The present disclosure relates to an electrical connector used for communication equipment, electric devices or electronic appliances, such as mobile terminals and audio equipment. More particularly, the present disclosure relates to a structure that is miniaturized (space-saving substrate footprint) and reduced in profile height, yet can maintain strength and connection stability to provide stable fitting.

BACKGROUND ART

Typically, a substrate-to-substrate electrical connector includes a plug connector and a receptacle connector. The plug connector and the receptacle connector are mounted on respective substrates thereof and fitted with each other to connect the substrates to each other. The plug connector includes at least a plug contact and a block. The receptacle connector includes at least a receptacle contact and a housing. In some cases, fixtures are used for the connectors, as necessary.

Below are shown documents regarding an electrical connector for a substrate-to-substrate connection which the applicant has previously proposed. The documents are as follows: Patent Document 1 (JP Patent Appl. Publ. No. 2009-266629), Patent Document 2 (JP Patent Appl. Publ., No, 2009-517802), Patent Document 3 (JP Patent Appl. Publ. No, 2010-198996), and Patent Document 4 (JP Patent Appl. No. 2011-107743).

[Patent Document 1]
JP Patent Appl. Publ. No. 2009-266629
[Patent Document 2]
JP Patent Appl. Publ. No. 2009-517802
[Patent Document 3]
JP Patent Appl. Publ. No. 2010-198996
[Patent Document 4]
JP Patent Appl. No. 2011-107743

DISCLOSURE OF THE INVENTION

Problems to be Solved by the Invention

In recent years, miniaturization of communication equipment, electric devices, electronic appliances, etc. as well as miniaturization of connectors has been in progress. There is a need for a stable fitting that allows miniaturization (space-saving substrate footprint) and reduction in profile height, yet maintains strength and connection stability. Meanwhile, miniaturization (space-saving substrate footprint) and reduction in profile height require thinning to the maximum extent. However, thinning reduces strength, which is contrary to the purpose of stable fitting.

Meanwhile, the techniques disclosed, in the aforementioned documents present the following problems:

In the structures of Patent Documents 1 and 2, a plug is connected to a receptacle at a single contact so that stable connection is difficult to provide. A bent elastic portion is provided on the receptacle contact to provide stable connection, preventing miniaturization in the width direction. The thicknesses at both ends in the longitudinal pitch direction are increased to provide strength, which prevents miniaturization.

In the structure of Patent Document 3, fixtures are arranged at both ends in the longitudinal pitch direction of a plug connector and a receptacle connector. The fixtures of the plug connector and the receptacle connector are engaged with each other to conduct current, preventing miniaturization in the longitudinal pitch direction. The contact portion of the receptacle contact is vertically upright, so the thickness at the central portion must be increased to allow movement of the contact portion, preventing miniaturization in the width direction.

In the structure of Patent Document 4, fixtures of a plug connector and a receptacle connector are not in contact with each other, so they cannot be used as a power source.

The present disclosure was made in view of the aforementioned conventional problems. It is an object of the present disclosure to provide an electrical connector that is miniaturized (space-saving substrate footprint) and reduced in profile height, yet can maintain strength and connection stability to provide stable fitting and use elastic fixtures as a power source.

Means for Solving the Problems

The object of the present disclosure can be achieved by an electrical connector, as stated in claim 1, comprising: a plug connector and a receptacle connector:

the plug connector and the receptacle connector detachably fitted with each other, the plug connector including:

a plurality of plug contacts, each plug contact including:

a contact portion contacting one of receptacle contacts; and a connection portion mounted on a substrate;

a block in which the plug contacts are held and arranged, the block having a first fitting opening for fitting therein a fitting portion of the receptacle connector; and a plurality of first fixtures, each having connection portions mounted on the substrate;

the receptacle connector including:

a plurality of receptacle contacts, each receptacle contact including:

a contact portion contacting one of the plug contacts, and a connection portion mounted on the substrate;

a housing in which the receptacle contacts are held and arranged, the housing having a fitting portion inserted into the first fitting opening of the plug connector and a second fitting opening for fitting therein the plug connector; and a plurality of second fixtures, each having connection portions mounted on the substrate, wherein the plug contact is held on the block by integral forming and provided with a recess into which one of the receptacle contacts is inserted, on the block, the first fixtures are held at both ends in a longitudinal pitch direction, and the plurality of plug contacts are oppositely arranged at both ends in a width direction, the first fixture is provided with two connection portions mounted on the substrate at both ends in the width direction and has a first contact means at a roughly central portion that contacts one of the second fixtures, the receptacle contact further includes an elastic portion which is bent at least once between the contact portion and the connection portion and a fixing portion for holding the receptacle contact on the housing, the contact portion, the elastic portion, the fixing portion, and the connection portion are arranged in an order as specified above, the contact portion is provided with a first chamfered portion, the elastic portion is provided with a second chamfered portion, an inclined portion is provided between the elastic portion and the contact portion, the housing is provided with insertion holes into which the receptacle contacts are inserted, the insertion hole is provided with an inclined curved portion, which is curved, at both ends in the longitudinal pitch direction and at both ends in the width direction, recesses are formed, each recess holding one of the second fixtures at a time of integral forming thereof and for simultaneously fitting therein one of the connection portions of the first fixtures, the roughly U-shaped second fixture is held on the housing by integral forming and has a second contact means at a roughly central portion that contacts one of the first fixtures, the roughly U-shaped second fixture is held by integral forming to increase a fracture strength of the housing at a time of fitting, each of the first contact means of the elastic first fixtures contacts one of the second contact means of the second fixtures so that the first and second fixtures are used as a power source, the inclined portions of the receptacle contacts and the inclined portions of the insertion holes of the housing are formed roughly in a same shape so that support of the receptacle contacts is adjusted to provide stable connection, each of the first chamfered portions of the receptacle contacts is engaged with one of the recesses of the plug contacts to produce feeling of clicking, and the receptacle contacts and the plug contacts are positioned and brought into contact with each other so that the plug contacts are held between the contact portions and the elastic portions of the receptacle contacts to provide stable connection.

The electrical connector of claim 2 according to claim 1 is an electrical connector, wherein the plug contact further includes another recess into which an elastic portion of the receptacle contact is inserted.

Further, the electrical connector of claim 3 according to claim 1 or 2, wherein the first contact means of the first fixture is an elastic first contact piece bent in a roughly J-shape, and the second contact means of the second fixture is an elastic second contact piece bent in a roughly S-shape.

Furthermore, the electrical connector of claim 4 according to claim 1 or 2, wherein the first contact means of the first fixture is an elastic first contact piece bent in a roughly J-shape, the second contact means of the second fixture is an elastic second contact piece which has a roughly I-shape, and a protruding piece is provided, such that the protruding piece is bent at a main body portion of the second fixture and is in parallel with the main body portion.

The electrical connector of claim 5 according to claim 1 or 2, wherein the first contact means of the first fixture is an elastic first contact piece bent in a roughly J-shape, and the second contact means of the second fixture is an elastic second contact piece bent in a roughly J-shape.

Further, the electrical connector of claim 6 according to claim 1 or 2, wherein the first contact means of the first fixture is an elastic first contact piece bent in a roughly J-shape, and the second contact means of the second fixture is an elastic second contact piece bent in a roughly L-shape.

Further, the electrical connector of claim 7 according to any one of claims 3 to 6, wherein in order to provide the second contact piece of the second fixture with elasticity, recesses are provided on both sides of the second contact piece.

Advantages of the Invention

As apparent from the foregoing description, the following advantageous effects can be obtained with the electrical connector according to the present disclosure. This electrical connector allows miniaturization (space-saving substrate footprint) and reduction in profile height, provides sufficient strength and excellent connection stability, allows an elastic fixture to be used as a power source, and provides stable fitting.

(1) Claim 1 states an electrical connector, comprising: a plug connector and a receptacle connector:

the plug connector and the receptacle connector detachably fitted with each other, the plug connector including:

a plurality of plug contacts, each plug contact including:

a contact portion contacting one of receptacle contacts; and a connection portion mounted on a substrate;

a block in which the plug contacts are held and arranged, the block having a first fitting opening for fitting therein a fitting portion of the receptacle connector; and a plurality of first fixtures, each having connection portions mounted on the substrate;

the receptacle connector including:

a plurality of receptacle contacts, each receptacle contact including:

a contact portion contacting one of the plug contacts, and a connection portion mounted on the substrate;

a housing in which the receptacle contacts are held and arranged, the housing having a fitting portion inserted into the first fitting opening of the plug connector and a second fitting opening for fitting therein the plug connector; and a plurality of second fixtures, each having connection portions mounted on the substrate, wherein the plug contact is held on the block by integral forming and provided with a recess into which one of the receptacle contacts is inserted, on the block, the first fixtures are held at both ends in a longitudinal pitch direction, and the plurality of plug contacts are oppositely arranged at both ends in a width direction, the first fixture is provided with two connection portions mounted on the substrate at both ends in the width direction and has a first contact means at a roughly central portion that contacts one of the second fixtures, the receptacle contact further includes an elastic portion which is bent at least once between the contact portion and the connection portion and a fixing portion for holding the receptacle contact on the housing, the contact portion, the elastic portion, the fixing portion, and the connection portion are arranged in an order as specified above, the contact portion is provided with a first chamfered portion, the elastic portion is provided with a second chamfered portion, an inclined portion is provided between the elastic portion and the contact portion, the housing is provided with insertion holes into which the receptacle contacts are inserted, the insertion hole is provided with an inclined curved portion, which is curved, at both ends in the longitudinal pitch direction and at both ends in the width direction, recesses are formed, each recess holding one of the second fixtures at a time of integral forming thereof and for simultaneously fitting therein one of the connection portions of the first fixtures, the roughly U-shaped second fixture is held on the housing by integral forming and has a second contact means at a roughly central portion that contacts one of the first fixtures, the roughly U-shaped second fixture is held by integral forming to increase a fracture strength of the housing at a time of fitting, each of the first contact means of the elastic first fixtures contacts one of the second contact means of the second fixtures so that the first and second fixtures are used as a power source, the inclined portions of the receptacle contacts and the inclined portions of the insertion holes of the housing are formed roughly in a same shape so that support of the receptacle contacts is adjusted to provide stable connection, each of the first chamfered portions of the receptacle contacts is engaged with one of the recesses of the plug contacts to produce feeling of clicking, and the receptacle contacts and the plug contacts are positioned and brought into contact with each other so that the plug contacts are held between the contact portions and the elastic portions of the receptacle contacts to provide stable connection.

In this way, an electrical connector can be obtained that is miniaturized (space-saving substrate footprint) and reduced in profile height, yet has a sufficient strength and connection stability, allows elastic fixtures to be used as a power source, and provides stable fitting.

(2) Claim 2 states the electrical connector according to claim 1, wherein the plug contact further includes another recess into which an elastic portion of the receptacle contact is inserted.

In this way, an electrical connector can be obtained that is miniaturized (space-saving substrate footprint) and reduced in profile height, yet has a sufficient strength and connection stability, allows elastic fixtures to be used as a power source, and provides stable fitting.

(3) Claim 3 states the electrical connector according to claim 1 or 2, wherein the first contact means of the first fixture is an elastic first contact piece bent in a roughly J-shape, and the second contact means of the second fixture is an elastic second contact piece bent in a roughly S-shape.

In this way, an electrical connector can be obtained that is miniaturized (space-saving substrate footprint) and reduced in profile height, yet has a sufficient strength and connection stability, allows elastic fixtures to be used as a power source, and provides stable fitting.

(4) Claim 4 states the electrical connector according to claim 1 or 2, wherein the first contact means of the first fixture is an elastic first contact piece bent in a roughly J-shape, the second contact means of the second fixture is an elastic second contact piece which has a roughly I-shape, and a protruding piece is provided, such that the protruding piece is bent at a main body portion of the second fixture and is in parallel with the main body portion.

In this way, an electrical connector can be obtained that is miniaturized (space-saving substrate footprint) and reduced in profile height, yet has a sufficient strength and connection stability, allows elastic fixtures to be used as a power source, and provides stable fitting.

(5) Claim 5 states the electrical connector according to claim 1 or 2, wherein the first contact means of the first fixture is an elastic first contact piece bent in a roughly J-shape, and the second contact means of the second fixture is an elastic second contact piece bent in a roughly J-shape.

In this way, an electrical connector can be obtained that is miniaturized (space-saving substrate footprint) and reduced in profile height, yet has a sufficient strength and connection stability, allows elastic fixtures to be used as a power source, and provides stable fitting.

(6) Claim 6 states the electrical connector according to claim 1 or 2, wherein the first contact means of the first fixture is an elastic first contact piece bent in a roughly J-shape, and the second contact means of the second fixture is an elastic second contact piece bent in a roughly L-shape.

In this way, an electrical connector can be obtained that is miniaturized (space-saving substrate footprint) and reduced in profile height, yet has a sufficient strength and connection stability, allows elastic fixtures to be used as a power source, and provides stable fitting.

(7) Claim 7 states the electrical connector according to any one of claims 3 to 6, wherein in order to provide the second contact piece of the second fixture with elasticity, recesses are provided on both sides of the second contact piece.

In this way, an electrical connector can be obtained that is miniaturized (space-saving substrate footprint) and reduced in profile height, yet has a sufficient strength and connection stability, allows elastic fixtures to be used as a power source, and provides stable fitting.

BRIEF DESCRIPTION OF THE DRAWINGS

FIG. 1(A) is a perspective view of a plug connector, viewed from the fitting direction.

FIG. 1(B) is a perspective view of a receptacle connector, viewed from the fitting direction.

FIG. 3(A) is a perspective view of a block, viewed from the fitting direction.

FIG. 3(B) is a cross-sectional view of a block cut along a portion into which a plug contact is inserted.

FIG. 4(A) is a perspective view of a plug contact, viewed from the contact portion side.

FIG. 4(B) is a perspective view of a plug contact, viewed from the side opposite from the contact portion.

FIG. 5(A) is a perspective view of a first fixture used for the plug connector of FIG. 1(A).

FIG. 5(B) is a perspective view of a second fixture used for the receptacle connector of FIG. 1(B).

FIG. 6(A) is a perspective view of a housing, viewed from the fitting direction.

FIG. 6(B) is a cross-sectional view of a housing, cut along a portion into which a receptacle contact is inserted.

FIG. 7(A) is a perspective view of a receptacle contact, viewed from the contact portion side.

FIG. 7(B) is a perspective view of a receptacle contact, viewed from the side opposite from the contact portion.

FIG. 8(A) is a perspective view of another second fixture different from the second fixture of FIG. 5(B), viewed from the fitting direction.

FIG. 8(B) is a perspective view of a receptacle connector using the second fixture of FIG. 8(A), viewed from the fitting direction.

FIG. 9(A) is a perspective view of still another second fixture different from the second fixture of FIG. 8(A), viewed from the fitting direction.

FIG. 9(B) is a perspective view of a receptacle connector which uses the second fixture of FIG. 9(A) and from which all receptacle contacts have been removed, viewed from the fitting direction.

FIG. 10(A) is a perspective view of still another second fixture different from the second fixture of FIG. 9(A), viewed from the fitting direction.

FIG. 10(B) is a perspective view of a receptacle connector which uses the second fixture of FIG. 10(A), from which all receptacle contacts have been removed, and which is cut along a center in the longitudinal pitch direction, viewed from the fitting direction.

FIG. 11(A) is a perspective view of still another second fixture different from the second fixture of FIG. 10(A), viewed from the fitting direction.

FIG. 11(B) is a perspective view of a receptacle connector which uses the second fixture of FIG. 11(A), from which all receptacle contacts have been removed, and which is cut along a center in the longitudinal pitch direction, viewed from the fitting direction.

DESCRIPTION OF REFERENCE NUMERALS

Figure 2:
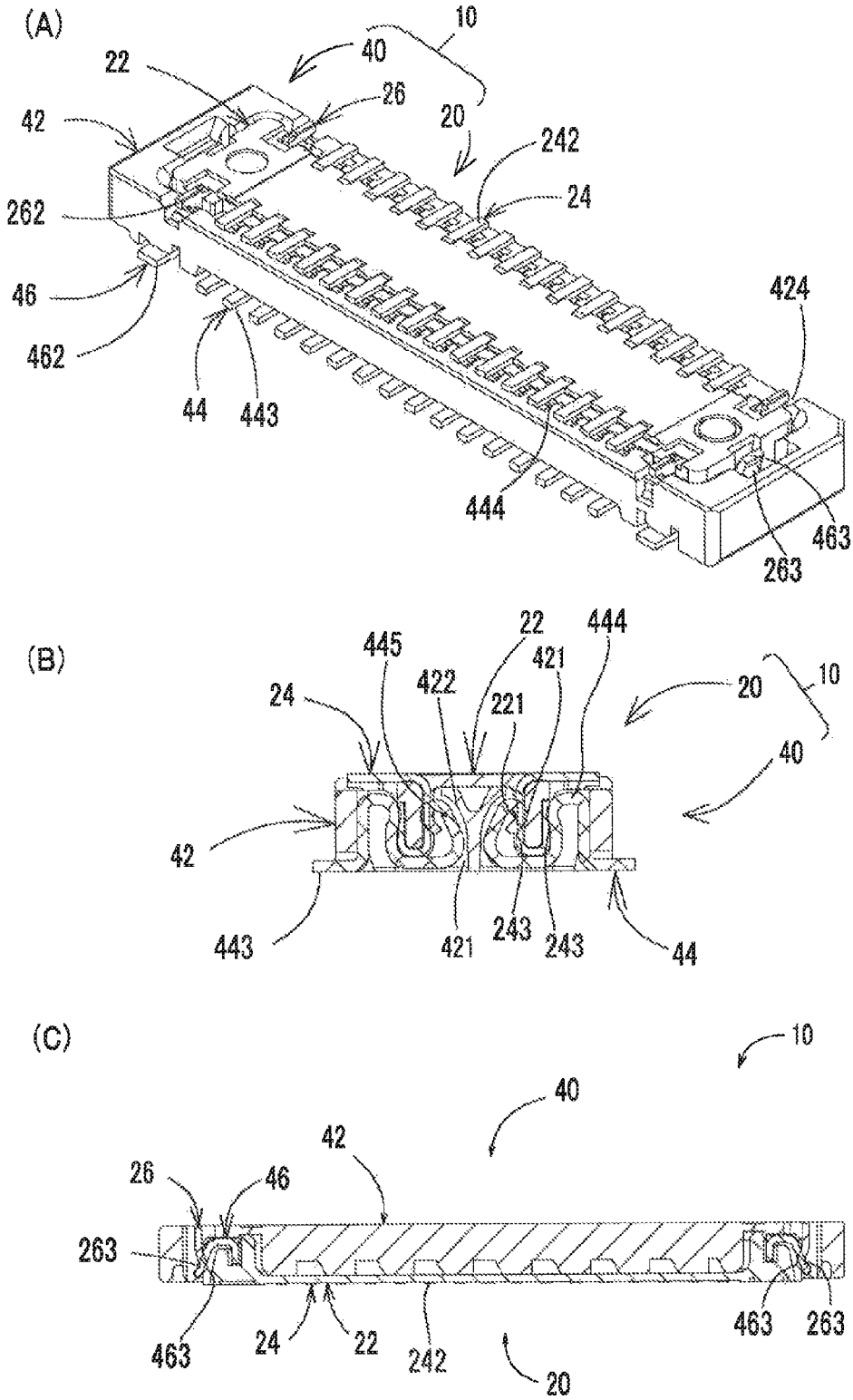
FIG. 2(A) is a perspective view of a state in which a plug connector is fitted with a receptacle connector.
FIG. 2(B) is a cross-sectional view of the connector in the state of FIG. 2(A), cut along a certain portion of the contact.
FIG. 2(C) is a cross-sectional view of the connector in the state of FIG. 2(A), cut along a center in the width direction.

10 electrical connector
12 first fitting opening
14 fitting portion
16 second fitting opening
20 plug connector
22 block
222 insertion groove
24 plug contact
241 contact portion
242 connection portion
243 recess
26 first fixture
261 main body portion
262 connection portion
263 first contact means
264 fixing portion
40 receptacle connector
42 housing
421 insertion hole
422 inclined portion
424 recess
44 receptacle contact
441 contact portion
442 fixing portion
443 connection portion
444 elastic portion
445 inclined portion
446 first chamfered portion
447 second chamfered portion
46 second fixture
461 main body portion
462 connection portion
463 second contact means
464 protruding portion
465 recess
466 protruding piece

DESCRIPTION OF THE PREFERRED EMBODIMENTS

FIGS. 1 and 2 present an electrical connector 10 comprising a plug connector 20 and a receptacle connector 40 which are detachably fitted with each other. The plug connector 20 includes: plug contacts 24 including contact portions 241 contacting receptacle contacts 44 and connection portions 242 mounted on a substrate; a block 22 in which the plug contacts 24 are held and arranged, the block 22 having a first fitting opening 12 into which a fitting portion 14 of the receptacle connector 40 is inserted; and first fixtures 26 having connection portions 262 mounted on the substrate. The receptacle connector 40 includes: the receptacle contacts 44 including contact portions 441 contacting the plug contacts 24 and connection portions 443 mounted on the substrate; a housing 42 in which the receptacle contacts 44 are held and arranged, the housing 42 having the fitting portion 14 inserted into the first fitting opening 12 of the plug connector 20 and a second fitting opening 16 into which the plug connector 20 is inserted; and second fixtures 46 having connection portions 462 mounted on the substrate. The plug contacts 24 are held on the block 22 by integral forming and are provided with recesses 243 into which the receptacle contacts 44 are inserted. The first fixtures 26 are held at both ends of the block 22 in the longitudinal pitch direction. The plurality of plug contacts 24 are oppositely arranged at both ends in the width direction of the block 22. The first fixtures 26 are provided with two connection portions 262, 262 mounted on the substrate at both ends in the width direction, and have first contact means 263 at a roughly central portion that contact the second fixtures 46. The receptacle contacts 44 includes, between the contact portions 441 and the connection portions 443, elastic portions 444 which are bent at least once and fixing portions 442 for holding the receptacle contacts 44 on the housing. The contact portions 441, the elastic portions 444, the fixing portions 442 and the connection portions 443 are arranged in this order. The contact portions 441 are provided with first chamfered portions 446. The elastic portions 444 are provided with second chamfered portions 447. Inclined portions 445 are provided between the elastic portions 444 and the contact portions 441. The housing 42 is provided with insertion holes 421 into which the receptacle contacts 44 are inserted. The insertion holes 421 are formed in curved inclined portions 422. At both ends in the longitudinal pitch direction and at both ends in the width direction of the housing 42, recesses 424 are formed such that the recesses 424 hold the second fixtures 46 at the time of integral forming thereof and simultaneously fit therein the connection portions 262 of the first fixtures 26. The roughly U-shaped second fixtures 46 are held on the housing 42 by integral forming and have second contact means 463 at a roughly central portion that contact the first fixtures 26. Since the roughly U-shaped second fixtures 46 are held by integral forming, the fracture strength of the housing 42 at the time of fitting is increased. The first contact means 263 of the elastic first fixtures 26 contact the second contact means 463 of the second fixtures 46, so that they are used as a power source. The inclined portions 445 of the receptacle contacts 44 and the inclined portions 422 of the insertion holes 421 of the housing 42 are formed roughly in the same shape so that support (backup function) of the receptacle contacts 44 is adjusted to provide stable connection. The first chamfered portions 446 of the receptacle contacts 44 are engaged with the recesses 243 of the plug contacts 24 to produce feeling of clicking. Also, the receptacle contacts 44 and the plug contacts 24 are positioned and brought into contact with each other so that the plug contacts 24 are held between the contact portions 441 and the elastic portions 444 of the receptacle contacts to provide stable connection.

In other words, when the connectors are fitted with each other, the first contact means 263 of the elastic first fixtures 26 contact the second contact means 463 of the second fixtures 46, so that they are used as a power source. The inclined portions 445 of the receptacle contacts 44 and the inclined portions 422 of the insertion holes 421 of the housing 42 are formed roughly in the same shape so that support (backup function) of the receptacle contacts 44 is adjusted to provide stable connection. The first chamfered portions 446 of the receptacle contacts 44 are engaged with the recesses 243 of the plug contacts 24 to produce feeling of clicking. Also, the receptacle contacts 44 and the plug contacts 24 are positioned and brought into contact with each other so that the plug contacts 24 are held between the contact portions 441 and the elastic portions 444 of the receptacle contacts to provide stable connection.

The electrical connector 10 of the present embodiment includes the plug connector 20 and the receptacle connector 40. The plug connector 20 includes the plurality of plug contacts 24, the block 22, and the first fixtures 26. The receptacle connector 40 includes the plurality of receptacle contacts 44, the housing 42, and the second fixtures 46.

First, the substrate 80 onto which the connectors 20, 40 are mounted is described, followed by an explanation of the electrical connector 10 of the present disclosure. The substrate 80 includes a hard substrate or FPC (flexible printed circuit substrate). Here, the description is given using the example of the hard substrate 80. The substrate 80 includes at least a land to be connected to the connection portion 242 of the contact 24 and to the connection portion 443 of the contact 44 as well as a pattern leading from the land to the circuit.

The electrical connector 10 of the present disclosure is described with reference to FIGS. 1 and 2. The plug connector 20 is illustrated in FIG. 1(A). Of the components of the plug connector 20, the plug contacts 24 are described first. The plug contacts 24 are made of metal and manufactured by a publicly known pressing technique. Examples of the material of the plug contacts 24, which is required to have springiness, conductivity, etc., include beryllium copper and phosphor bronze.

In the present embodiment, the plug contact 24 has a roughly L-shape, as shown in FIG. 4. The plug contact 24 includes at least the contact portion 241 that contacts the receptacle contact 44, which is the other contact, and the connection portion 242 connected to the substrate 80. In the present embodiment, the plug contact 24 is held on the block 22 by integral forming.

The contact portion 241 of the plug contact 24 is provided with the recess 243 into which the receptacle contact 44 is inserted. When the first chamfered portion 446 of the receptacle contact 44 is inserted into the recess 243, misalignment is suppressed, and feeling of clicking and stable connection can be provided. The recess 243 may be of any shape and size as long as the receptacle contact 44 can be inserted, and it is properly designed in line with the shape and size of the receptacle contacts 44 to provide stable connection.

The connection portion 242 is a portion to be mounted on the substrate. In the present embodiment, the connection portion 242 is of a surface mount (SMT) type, but may also be of a DIP type as long as it can be mounted on the substrate.

Preferably, the plug contact 24 is provided with another recess 243 on the opposite side (back side) of the contact portion 241. When the second chamfered portion 447 of the receptacle contact 44 is inserted into the other recess 243, the plug contacts 24 is held between the first chamfered portion 446 and the second chamfered portion 447 of the receptacle contact 44 so that misalignment is more suppressed, and that feeling of clicking and stable connection can be provided. The other recess 243 may be of any shape and size as long as the receptacle contact 44 can be inserted, and it is properly designed in line with the shape and size of the receptacle contacts 44 to provide stable connection.

Next, the first fixture 26 is described with reference to FIG. 5(A). The first fixture 26 is made of metal and manufactured by a publicly known pressing technique. Examples of the material of the first fixture 26, which is required to have springiness, formability, etc., include beryllium copper and phosphor bronze. The first fixture 26 is roughly plate-shaped, as shown in FIG. 5(A).

The first fixtures 26 include the connection portions 262, 262 connected to the substrate 80 at both ends in the width direction, and a main body portion 261 between the connection portions 262. The first fixture 26 further includes the first contact means 263 that contacts the second fixture 46 at a roughly central portion of the main body portion 261. Further, fixing portions 264 for holding the first fixture 26 on the block 22 are provided at a predetermined location. In the present embodiment, the connection portions 262 are of a surface mount (SMT) type in consideration of the mounting density, etc., but may also be of a DIP type.

The fixing portions 264 are only required to be fixed to the block 22. The shape and size thereof are properly designed in consideration of the holding force, miniaturization of the connector, strength, workability, etc. In the present embodiment, the fixing portions 264 are fixed by press-fitting. As shown in FIG. 5(A), the fixing portions 264 are formed on the two connection portions 262 and the main body portion 261 so as to be protruded oppositely to each other.

The first contact means 263 is a portion to be in contact with the second fixture 46 of the receptacle connector 40. The first contact means 263 may be of any shape and size as long as it can be in contact with the second fixture 46. The first contact means 263 is properly designed in consideration of the connection stability, elasticity, workability, strength, etc. In the present embodiment, the first contact means 263 is bent at the main body portion 261 in a roughly J-shape. The first contact means 263 of the plug connector 20 is in contact with the second fixtures 46 of the receptacle connector 40, so that it is used as a power source.

Next, the block 22 is described with reference to FIG. 3. The block 22 is made of electrically insulating plastic and manufactured by a publicly known injection forming technique. The material thereof is properly selected in consideration of dimensional stability, workability, cost, etc., and examples thereof typically include polybutylene terephthalate (PBT), polyamides (66PA, 46PA), liquid crystal polymers (LCP), polycarbonates (PC), and synthetic materials thereof. The plug contacts 24 and the first fixtures 26 are mounted on the block.

The block 22 is provided with the first fitting opening 12 into which the fitting portion 14 of the receptacle connector 40 is inserted when the plug connector 20 is fitted with the receptacle connector 40. The first fitting opening 12 is only required to fit therein the fitting portion 14. The shape and size of the block 22 are properly designed in line with the fitting portion 14 in consideration of strength, workability, connection stability, etc.

The block 22 is provided with insertion grooves 222 into which the first fixtures 26 are inserted, at both ends in the longitudinal pitch direction. The insertion grooves 222 are fixed by means of press-fitting, engagement (lance), welding, or the like. In the present embodiment, the insertion grooves 222 are fixed by press-fitting. The shape and size of the insertion grooves 222 may be of any type as long as the first fixtures 26 can be inserted and held. The insertion grooves 222 are properly designed in consideration of the holding strength, strength, workability, etc.

Next, the receptacle connector 40 is described with reference to FIG. 1(B). First, the receptacle contact 44 is described. The receptacle contact 44 is made of metal and manufactured by a publicly known pressing technique. Examples of the material of the receptacle contact 44, which is required to have springiness, conductivity, etc., include beryllium copper and phosphor bronze. The receptacle contact 44 includes the contact portion 441 that contacts the plug contact 24, which is the other contact, the connection portion 443 connected to the substrate, the elastic portion 444 which is bent at least once between the contact portion 441 and the connection portion 443, and the fixing portion 442 for holding the receptacle contact 44 on the housing 42. The contact portion 441, the elastic portion 444, the fixing portion 442, and the connection portion 443 are arranged in this order. Also, the contact portion 441 is provided with the first chamfered portion 446. The elastic portion 444 is provided with the second chamfered portion 447. The inclined portion 445 is provided between the elastic portion 444 and the contact portion 441.

The contact portion 441 is a portion to be in contact with the plug contact 24. The shape of the contact portion 441 is designed to allow surface contact in consideration of connection stability. The contact portion 441 is provided with the first chamfered portion 446 to facilitate insertion into the recess 243 of the plug contacts 24. The shapes and sizes of the contact portion 441 and the first chamfered portion 446 are properly designed in consideration of such roles, connection stability, workability, etc.

The connection portion 443 is a portion to be mounted on the substrate. In the present embodiment, the connection portion 443 is of a surface mount (SMT) type. The connection portion 443 may also be of a DIP type or a pressed-in type as long as it can be mounted on the substrate. The connection portion 443 is designed in consideration of the substrate footprint, mounting density, etc.

The elastic portion 444 is a portion for providing elastic length and elastic force as well as stable connection between the receptacle contact 44 and the plug contact 24. Also, the elastic portion 444 is provided with the second chamfered portion 447 to facilitate insertion into the recess 243 of the plug contact 24. The shapes and sizes of the elastic portion 444 and the second chamfered portion 447 are properly designed in consideration of such roles, connection stability, workability, etc. In other words, the elastic portion 444 is also used as the second contact portion so that the plug contacts 24 are held between the contact portion 441 and the elastic portion 444 of the receptacle contacts to provide stable connection.

The inclined portion 445 provided between the contact portion 441 and the elastic portion 444 is a portion that is formed in roughly the same shape as the inclined portion 422 of the insertion hole 421 of the housing 42 so as to adjust support (backup function) and to provide stable connection. The shape and size of the inclined portion 445 are properly designed in line with the inclined portion 422 of the housing 42 in consideration of such role, connection stability, workability, etc.

The fixing portion 442 is a portion to be fixed to the housing 42. The fixing portions 442 are fixed to the housing 42 by press-fitting, engagement (lance), welding, or the like. In the present embodiment, the fixing portion 442 is fixed by press-fitting. The shape and size of the fixing portion 442 are properly designed in consideration of the holding force, strength, workability, etc.

Next, the housing 42 is described with reference to FIG. 6. The housing 42 is made of electrically insulating plastic and manufactured by a publicly known injection forming technique. The material thereof is properly selected in consideration of dimensional stability, workability, cost, etc., and examples thereof typically include polybutylene terephthalate (PBT), polyamides (66PA, 46PA), liquid crystal polymers (LCP), polycarbonates (PC), and synthetic materials thereof.

The housing 42 includes the fitting portion 14 that is inserted into the first fitting opening 12 of the plug connector 20, and the second fitting opening 16 into which the plug connector 20 is inserted. The only requirements for the shapes and sizes of the fitting portion 14 and the second fitting opening 16 are that the fitting portion 14 can be inserted into the first fitting opening 12 and that the second fitting opening 16 can fit therein the plug connector 20. The fitting portion 14 and the second fitting opening 16 are properly designed in line with the shape and size of the plug connector 20 in consideration of miniaturization of the connector, connection stability, strength, workability, etc.

On the housing 42, required numbers of the receptacle contacts 44 and the second fixtures 46 are mounted. Therefore, the housing 42 is provided with the insertion holes 421 into which the required number of the receptacle contacts 44 are mounted. The second fixtures 46, which are held by integral forming, do not require insertion holes etc. The insertion holes 421 are only required to fit therein the receptacle contacts 44. The shape and size thereof are properly designed in consideration of the connection stability, holding force, strength, workability, etc.

The insertion holes 421 are provided with the inclined portions 422, which is curved. The inclined portions 422 are formed in line with the inclined portions 445 of the receptacle contacts 44. The inclined portions 422 are portions for adjusting support (backup function) by, for example, preventing uplifting, etc. to provide stable connection. The shape and size of the inclined portions 422 are properly designed in line with the inclined portions 445 of the receptacle contacts 44 in consideration of such role, connection stability, workability, etc.

The housing 42 is provided with the recesses 424 that hold the second fixtures 46 at the time of integral forming thereof and simultaneously fit therein the connection portions 262 of the first fixtures 26, at both ends in the longitudinal pitch direction and at both ends in the width direction. The shape and size of the recesses 424 are properly designed in consideration of such role, reduction in profile height, strength, workability, etc.

Finally, the second fixture 46 is described with reference to FIG. 5(B). The second fixture 46 is made of metal and manufactured by a publicly known pressing technique. Examples of the material of the second fixture 46, which is required to have springiness, formability, etc., include beryllium copper and phosphor bronze.

The second fixture 46 includes at least connection portions 462 connected to the substrate, and the second contact means 463 that contacts the first contact means 263 of the first fixture 26. In the present embodiment, the second fixture 46 further includes a main body portion 461, and protruding portions 464 protruding from the main body portion 461 at a substantially right angle. In the present embodiment, the connection portions 462 are of a surface mount (SMT) type in consideration of the mounting density, etc., but may also be of a DIP type. The connection portions 462 are provided at both ends in the width direction of the second fixture 46.

The second fixture 46 is held on the housing 42 by integral forming. The main body portion 461 and the protruding portions 464 are portions for reinforcing the strength of the housing 42. The shapes and sizes of the main body portions 461 and the protruding portions 464 are only required to reinforce the strength and are properly designed in consideration of strength, workability, etc.

The second contact means 463 is a portion to be in contact with the first fixture 26 of the plug connector 20 and may be of any shape and size as long as it can contact the first fixtures 26 in consideration of connection stability, elasticity, workability, strength, etc. In the present embodiment, the second contact means 463 is elastically bent at the main body portion 261 in a roughly S-shape. The second contact means 463 of the receptacle connector 40 contact the first contacts means 26 of the plug connector 20 so that they are used as a power source.

In the present embodiment, at a base portion of the second contact means 463 of the main body portion 461, a recess 465 for increasing elastic length (increasing elasticity) is formed. The shape and size of the recess 465 are designed in consideration of connection stability, elasticity, strength, workability, etc.

Hereinafter, another second fixture 26 is described, but the purpose and the material thereof are the same as the aforementioned second fixture. Only the differences are described.

Another second fixture 46 is described with reference to FIG. 8.

A second contact means 463 of this second fixture is a roughly I-shaped, elastic second contact piece. Further, a protruding piece 466 is provided at a main body portion 461 of the second fixture 46, and the protruding piece 466 is bent in such a way to be in parallel with the main body portion 461. The protruding piece 466 is to provide more strength when the second fixture 46 is integrally formed with the housing 42. In the present embodiment, a surface of the protruding piece 466 is exposed on the housing 42. However, the surface of the protruding piece 466 may be fully embedded in the housing 42 with no exposure at all.

Another second fixture 46 is described with reference to FIG. 9. The material is the same as the aforementioned second fixture.

A second contact means 463 of this second fixture is an elastic second contact piece bent in a roughly J-shape. The second contact piece is bent from the substrate side to the fitting side.

Another second fixture 46 is described with reference to FIG. 10. The material is the same as the aforementioned second fixture.

A second contact means 463 of this second fixture is an elastic second contact piece bent in a roughly J-shape. The second contact piece is bent from the fitting side to the substrate side.

Another second fixture 46 is described with reference to FIG. 11. The material is the same as the aforementioned second fixture.

A second contact means 463 of this second fixture is an elastic second contact piece bent in a roughly L-shape. The second contact piece is bent from the fitting side to the substrate side.

[Industrial Applicability]

The present disclosure relates to an electrical connector used for communication equipment, electric devices or electronic appliances, such as mobile terminals and audio equipment. Particularly, the present disclosure relates to a structure that is miniaturized (space-saving substrate footprint) and reduced in profile height, yet can maintain strength and connection stability to provide stable fitting.

What is claimed is:

1. An electrical connector, comprising a plug connector and a receptacle connector:

the plug connector and the receptacle connector detachably fitted with each other, the plug connector including:

a plurality of plug contacts, each plug contact including:

a contact portion contacting one of receptacle contacts; and a connection portion mounted on a substrate;

a block in which the plug contacts are held and arranged, the block having a first fitting opening for fitting therein a fitting portion of the receptacle connector; and a plurality of first fixtures, each having connection portions mounted on the substrate;

the receptacle connector including:

a plurality of receptacle contacts, each receptacle contact including:

a contact portion contacting one of the plug contacts, and a connection portion mounted on the substrate;

a housing in which the receptacle contacts are held and arranged, the housing having a fitting portion inserted into the first fitting opening of the plug connector and a second fitting opening for fitting therein the plug connector; and a plurality of second fixtures, each having connection portions mounted on the substrate, wherein the plug contact is held on the block by integral forming and provided with a recess into which one of the receptacle contacts is inserted, on the block, the first fixtures are held at both ends in a longitudinal pitch direction, and the plurality of plug contacts are oppositely arranged at both ends in a width direction, the first fixture is provided with two connection portions mounted on the substrate at both ends in the width direction and has a first contact means at a roughly central portion that contacts one of the second fixtures, the receptacle contact further includes an elastic portion which is bent at least once between the contact portion and the connection portion and a fixing portion for holding the receptacle contact on the housing, the contact portion, the elastic portion, the fixing portion, and the connection portion are arranged in an order as specified above, the contact portion is provided with a first chamfered portion, the elastic portion is provided with a second chamfered portion, an inclined portion is provided between the elastic portion and the contact portion, the housing is provided with insertion holes into which the receptacle contacts are inserted, the insertion hole is provided with an inclined portion which is curved, at both ends in the longitudinal pitch direction and at both ends in the width direction, recesses are formed, each recess holding one of the second fixtures at a time of integral forming thereof and for simultaneously fitting therein one of the connection portions of the first fixtures, the roughly U-shaped second fixture is held on the housing by integral forming and has a second contact means at a roughly central portion that contacts one of the first fixtures, the roughly U-shaped second fixture is held by integral forming to increase a fracture strength of the housing at a time of fitting, each of the first contact means of the elastic first fixtures contacts one of the second contact means of the second fixtures so that the first and second fixtures are used as a power source, the inclined portions of the receptacle contacts and the inclined portions of the insertion hole of the housing are formed roughly in a same shape so that support of the receptacle contacts is adjusted to provide stable connection, each of the first chamfered portions of the receptacle contacts is engaged with one of the recesses of the plug contacts to produce feeling of clicking, and the receptacle contacts and the plug contacts are positioned and brought into contact with each other so that the plug contacts are held between the contact portions and the elastic portions of the receptacle contacts to provide stable connection.

2. The electrical connector according to claim 1, wherein the plug contact further includes another recess into which an elastic portion of the receptacle contact is inserted.

3. The electrical connector according to claim 1, wherein the first contact means of the first fixture is an elastic first contact piece bent in a roughly J-shape, and the second contact means of the second fixture is an elastic second contact piece bent in a roughly S-shape.

4. The electrical connector according to claim 1, wherein the first contact means of the first fixture is an elastic first contact piece bent in a roughly J-shape, the second contact means of the second fixture is an elastic second contact piece which has a roughly I-shape, and a protruding piece is provided, such that the protruding piece is bent at a main body portion of the second fixture and is in parallel with the main body portion.

5. The electrical connector according to claim 1, wherein the first contact means of the first fixture is an elastic first contact piece bent in a roughly J-shape, and the second contact means of the second fixture is an elastic second contact piece bent in a roughly J-shape.

6. The electrical connector according to claim 1, wherein the first contact means of the first fixture is an elastic first contact piece bent in a roughly J-shape, and the second contact means of the second fixture is an elastic second contact piece bent in a roughly L-shape.

7. The electrical connector according to claim 3, wherein in order to provide the second contact piece of the second fixture with elasticity, recesses are provided on both sides of the second contact piece.

* * * * *